United States Patent [19]

Usami et al.

[11] Patent Number: 4,857,501

[45] Date of Patent: Aug. 15, 1989

[54] MANUFACTURING METHOD OF A HEAT SENSITIVE RECORDING MATERIAL

[75] Inventors: Toshimasa Usami; Akihiro Shimomura; Sumitaka Tatsuta; Seiji Hatakeyama, all of Shizuoka, Japan

[73] Assignee: Fuji Photo Film Co., Ltd., Kanagawa, Japan

[21] Appl. No.: 138,163

[22] Filed: Dec. 28, 1987

[30] Foreign Application Priority Data

| | | | |
|---|---|---|---|
| Dec. 25, 1986 | [JP] | Japan | 61-203748 |
| Apr. 9, 1987 | [JP] | Japan | 62-088196 |
| Apr. 9, 1987 | [JP] | Japan | 62-088197 |

[51] Int. Cl.[4] ..... B41M 5/18

[52] U.S. Cl. ..... 503/200; 427/150; 427/151; 427/152; 428/204; 428/913; 503/215; 503/225; 503/226

[58] Field of Search ..... 428/203, 204, 207, 211, 428/913; 503/200, 206, 226, 213, 215, 225; 427/150–152

[56] References Cited

U.S. PATENT DOCUMENTS

| | | | |
|---|---|---|---|
| 4,577,205 | 3/1986 | Shibata et al. | 428/207 |
| 4,711,874 | 12/1987 | Yuyama et al. | 428/204 |

*Primary Examiner*—Bruce H. Hess

*Attorney, Agent, or Firm*—Sughrue, Mion, Zinn, Macpeak & Seas

[57] ABSTRACT

This invention discloses a manufacturing method of a heat sensitive material having a transparent heat sensitive layer comprised of controlling transparency of heat sensitive layer by coating a composition containing an emulsified dispersion prepared by dispersing a color developer dissolved into an organic solvent slightly soluble or insoluble in water and microcapsules containing at least a colorless or light colored electron donating dye precursor (core material) and then drying the coat, in which a refractive index of the core material and that of an oil phase of the color developer dispersion are properly adjusted. When providing a transparent heat sensitive layer obtained by the above method on a printed support, a printed matter can be seen through the heat sensitive layer.

6 Claims, 1 Drawing Sheet

MANUFACTURING METHOD OF A HEAT SENSITIVE RECORDING MATERIAL

FIELD OF THE INVENTION

The present invention relates to a heat sensitive recording material, and more particularly, to a manufacturing method of a heat sensitive recording material having excellent transparency and being convenient for a special use.

BACKGROUND OF THE INVENTION

A heat-sensitive recording method has many advantages in that no particular developing step is required, (2) if paper is used as a support, the recording material can have a quality akin to that of plain paper, (3) handling of the recording material used is easy, (4) the images recorded have high color density, (5) this method can be effected using a simple and cheap apparatus and (6) no noise is caused during recording. Therefore, heat-sensitive recording materials have recently enjoyed a markedly increasing demand, particularly for use with a facsimile or printer, and have come to be used for many purposes such as a pass, a label or a score card. Moreover, it has been desired to devise transparent heat-sensitive recording materials which enable direct recording with a thermal head in order to adapt them for multicolor development, or to make them usable for an overhead projector (hereinafter abbreviated as OHP).

A possibility of provision of such transparent heat-sensitive recording materials depends on a possibility of provision of a transparent heat sensitive layer, and it is easily estimated that a demand for heat-sensitive recording material will be enlarged if said transparent heat-sensitive recording material is really provided.

For example, in a case when a heat sensitive recording material is used for before mentioned label etc., usually a heat sensitive layer is coated on a support then required format such as a ruled line, a trade name, quantity etc., are thermally printed on the heat sensitive layer. In this case, however, a stain which is caused by unexpected coloring is occurred when an organic solvent etc. are adsorbed on the heat sensitive layer. Therefore, a protective layer comprised of a material which is not damaged by the organic solvent should be provided on the heat sensitive layer to prevent above mentioned stain. Moreover, on these labels water such as rain often adsorbs then water soluble printing ink can not be used. Therefore, a special ink which contains selected organic solvents should be employed, but in this case, these organic solvents are often not good for health and a manufacturing cost becomes higher, and moreover a blocking phenomenon is apt to occurs in a manufacturing process since a long time is necessary to dry the printed labels. These disadvantages are solved if it is possible to set a transparent heat sensitive layer on a support having desired matters in print. However, heat sensitive layer of a conventional heat sensitive recording material which can be recorded by thermal head is not transparent, then a desired transparency of the heat sensitive recording material can not be realized even if the conventional heat sensitive layer is provided on a transparent support.

A transparent heat sensitive recording material which is known so far can not answer to the above mentioned new needs, since the transparent heat sensitive recording material is a type which is used by contacting with original document then exposing the recording material to light; a temperature of an image part is increased by an absorption of infrared light by image part of original then the recording material is colored imagewisely.

As the concentration of our energies on solution of the above described defects, it has been found that when adopting a combination of colorless or light colored electron donating dye precursor and color developer as a coloring agents, and microencapsulating the former and dispersing the latter in a special conditions, a transparent heat sensitive layer can be obtained by coating a mixed solution of a solution containing the microcapsules and developer dispersed solution. It has also been found that a transparency of the heat sensitive layer can be adjusted by selecting a ratio of two refractive indexes; one refractive index is that of a component contained in the microcapsule and the other is that of oily component contained in the developer emulsion.

SUMMARY OF THE INVENTION

The first object of the present invention is to provide a method to produce a transparent heat sensitive material having a transparent heat sensitive layer.

The second object of the present invention is to provide a method to control a transparency of a transparent heat sensitive layer.

The third object of the present invention is to provide a heat sensitive recording material comprising a transparent heat sensitive layer provided on a printed support so that one can see the printed matter.

The fourth object of the present invention is to provide a heat sensitive recording label comprising a transparent heat sensitive layer provided on a support on which desired matters are already printed.

The above-described objects are attained by coating a composition containing an emulsified dispersion prepared by dispersing color developer dissolved into an organic solvent slightly soluble or insoluble in water and microcapsules containing at least a colorless or light colored electron donating dye precursor; adjusting a refractive index of a core material contained in the microcapsule and that of a nonvolatile oily phase of a dispersion comprising developer and organic solvent.

According to the present invention an excellent label, pass etc. can be obtained easily by providing the transparent heat sensitive layer on a printed support.

DETAILED DESCRIPTION OF THE INVENTION

Figure 1:
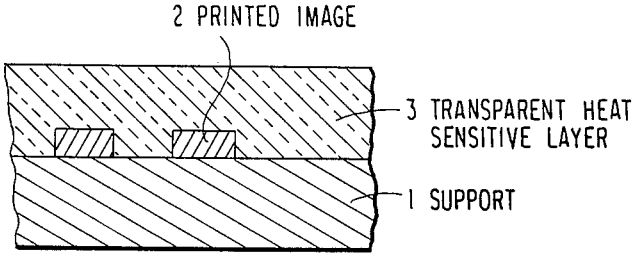
FIG. 1 is a conceptional cross section of an embodiment of the heat sensitive recording material of the present invention. In the drawing, symbols 1, 2 and 3 represent a support, printed image and a transparent heat sensitive layer respectively.

Details of a transparent heat sensitive layer constituting the present heat sensitive materials are as follows.

Electron donating dye precursors to be employed in the present invention are selected properly from known colorless or light colored compounds of the kind which can develop their colors by donating an electron or accepting a proton of an acid or the like. These compounds have such a skeleton as that of lactone, lactam, sultone, spiropyran, ester, amide, etc., as a part of their structures, and these skeletons undergo ring-opening or bond cleavage upon contact with a color developer.

Preferred examples of such compounds include triarylmethane compounds, diphenylmethane compounds, xanthene compounds, thiazine compounds, spiropyran compounds and so on.

Particularly preferred compounds are those represented by the following general formula:

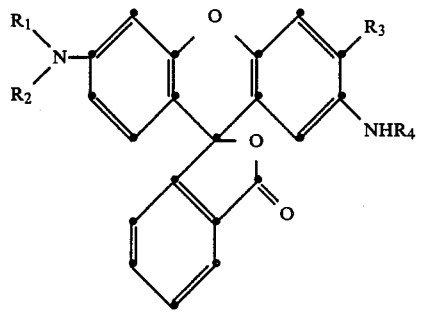

In the foregoing formula, $R_1$ represents an alkyl group containing 1 to 8 carbon atoms; $R_2$ represents an alkyl or alkoxyalkyl group containing 4 to 18 carbon atoms, or a tetrahydrofuryl group; $R_3$ represents a hydrogen atom, an alkyl group containing 1 to 15 carbon atoms, or a halogen atom; and $R_4$ represents a substituted or unsubstituted aryl group containing 6 to 20 carbon atoms. As substituent group for $R_4$, alkyl, alkoxy and halogenated alkyl groups containing 1 to 5 carbon atoms, and halogen atoms are preferred.

Microencapsulation of the above-described color former in the present invention can prevent generation of fog during production of a heat sensitive material and, at the same time, can improve a freshness keeping quality of a heat sensitive material and a keeping quality of the record formed. Therein, the image density at the time of recording can be heightened by properly selecting a material and a method for forming a microcapsule wall. A preferred amount of the color former used is 0.05 to 5.0 g per square meter.

Suitable examples of wall materials for microcapsules include polyurethane, polyurea, polyester, polycarbonate, urea/formaldehyde resin, melamine resin, polystyrene, styrene/ m ethacrylate copolymer, styrene/acrylate copolymer, gelatin, polyvinyl pyrrolidone, polyvinyl alcohol, and so on. These macromolecular substances can be used in combination of two or more thereof in the present invention.

Of the above-cited macromolecular substances, polyurethane, polyurea, polyamide, polyester, and polycarbonate are preferred in the present invention. In particular, polyurethane and polyurea can bring about good results.

Microcapsules to be employed in the present invention are preferably prepared by emulsifying a core material containing a reactive substance like a color former, and then forming a wall of a macromolecular substance around the droplets of the core material to microencapsulate the core material. Therein, reactants to produce a macromolecular substance are added to the inside and/or the outside of the oily droplets. For details of microcapsules which can be preferably employed in the present invention, e.g., for production methods of microcapsules which can be preferably used, descriptions in Japanese Patent Application (OPI) No. 242094/85 (the term "OPI" as used herein means an "unexamined published application"), and so on can be referred to.

An organic solvent to constitute the above-described oil droplets can be properly selected from those used generally for pressure sensitive material.

Some of desirable oils are compounds represented by the following general formulae (I) to (III), triarylmethanes (such as tritoluylmethane, toluyldiphenylmethane), terphenyl compounds (such as terphenyl), alkylated diphenyl ethers (such as propyldiphenyl ether), hydrogenated terphenyl compounds (such as hexahydroterphenyl), diphenyl ethers, chlorinated paraffins and so on.

(I)

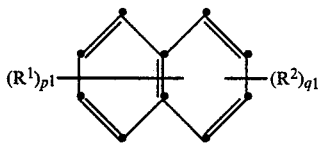

In the above formula, $R^1$ represents a hydrogen atom, or an alkyl group containing 1 to 18 carbon atoms; $R^2$ represents an alkyl group containing 1 to 18 carbon atoms; and $p^1$ and $q^1$ each represents an integer of 1 to 4, provided that the total number of alkyl groups therein is 4 or less. Preferred alkyl groups represented by $R^1$ and $R^2$ are those containing 1 to 8 carbon atoms.

(II)

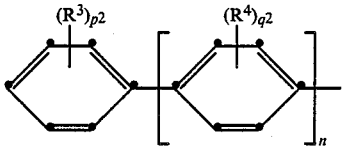

In the above formula, $R^3$ represents a hydrogen atom, or an alkyl group containing 1 to 12 carbon atoms; $R^4$ represents an alkyl group containing 1 to 12 carbon atoms; and n is 1 or 2. $p^2$ and $q^2$ each represents an integer of 1 to 4. The total number of alkyl groups is 4 or less in case of n=1, while it is 6 or less in case of n=2.

(III)

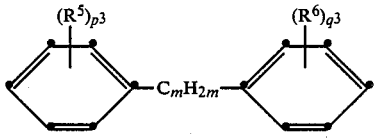

In the above formula, $R^5$ and $R^6$, which may be the same or different, each represents a hydrogen atom, or an alkyl group containing 1 to 18 carbon atoms. m represents an integer of 1 to 13. $p^3$ and $q^3$ each represents an integer of 1 to 3, provided that the total number of alkyl groups is 3 or less.

Of alkyl groups represented by $R^5$ and $R^6$, those containing 2 to 4 carbon atoms are particularly preferred.

Specific examples of the compounds represented by the formula (I) include dimethylnaphthalene, diethylnaphthalene, diisopropylnaphthalene, and the like.

Specific examples of the compounds represented by the formula (II) include dimethylbiphenyl, diethylbiphenyl, diisopropylbiphenyl, diisobutylbiphenyl, and the like.

Specific examples of the compounds represented by the formula (III)include 1-methyl-1-dimethylphenyl-1-phenylmethane, 1-ethyl-1-dimethylphenyl-1-phenylmethane, 1-propyl-1-dimethylphenyl-1-phenylmethane, and the like.

The above-cited oils can be used as a mixture of two or more thereof, or in combination with other oils.

A preferred size of microcapsules to be employed in the present invention is 4 microns or less, particularly 2, 5 micron or less, on a volume average basis according to the evaluation method described, e.g., in Japanese Patent Application (OPI) No. 214990/85.

Desirable microcapsules which are produced in the above-described manner are not those of the kind which are disrupted by heat or pressure, but those of the kind which have a microcapsule wall through which reactive substances present inside and outside the individual microcapsules respectively can permeate at high temperature to react with each other.

Multicolored neutral tints can be effected by preparing some kinds of microcapsules having walls differing in glass transition point through proper selection of wall materials, and optional addition of glass transition point controlling agents (e.g., plasticizers described in Japanese Patent Application (OPI)No. 277490/86) to the wall materials, respectively, and further by combining selectively colorless electron donating dye precursors differing in hue with their respective color developers. Therefore, the present invention is not limited to a monochromatic heat sensitive recording material but can be applied to a two-color or multicolor heat sensitive recording material and a heat sensitive recording material suitable for recording of graded image.

In addition, a photodiscoloration inhibitor as described, e.g., in Japanese Patent Application (OPI) Nos. 283589/86, 283590/86 and 283591/86 can be added, if desired.

Color developers to be employed in the present invention, which undergo the color development reaction with electron donating colorless precursors when heated, can be those selected properly from known color developers. For instance, suitable examples of color developers to be combined with leuco dyes include phenol compounds, sulfur-contained phenolic compounds, carboxylic acid compounds, sulfon compounds, urea or thiourea compounds, and so on. Details of the color developers are described, e.g., in "Kami Pulp Gijutsu Times," pp. 49–54, and pp. 65–70 (1985). Of such color developers, those having melting points of 50° to 250° C., particularly phenols and organic acids which have melting points of 60° to 200° C. and are hardly soluble in water, are preferred over others. Combined use of two or more of color developers is desirable because of increase in solubility.

Color developers preferred particularly in the present invention are represented by the following general formulae (IV) to (VII):

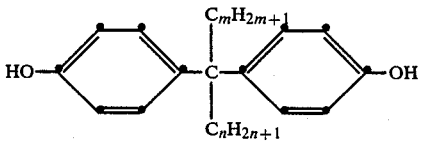

(IV)

m = 0–2, n = 2–11

-continued

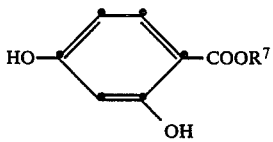

(V)

$R^7$ is an alkyl group, an aryl group, an aryloxy group, or an aralkyl group. In particular, methyl group, ethyl group and butyl group are preferred as $R^7$.

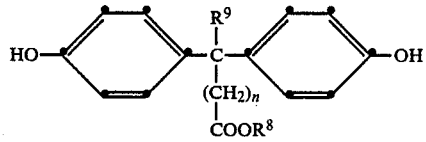

(VI)

$R^8$ is an alkyl group. In particular, butyl group, pentyl group, heptyl group, and octyl group are preferred as $R^8$.

$R^9$ is a hydrogen atom or methyl group and n is 0–2.

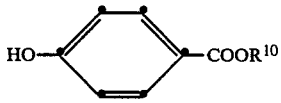

(VII)

$R^{10}$ is an alkyl group, an aryloxy group, or an aralkyl group.

In the present invention, such a color developer is used in a form of emulsified dispersion. The dispersion can be prepared by dissolving color developers in an organic solvent slightly soluble or insoluble in water, and mixing the resulting solution with an aqueous phase which contains a surface active agent, and a water-soluble high polymer as a protective colloid to emulsify and to disperse the solution in the aqueous phase.

An organic solvent to be used for dissolving the color developers can be properly selected from known oils.

In the present invention, esters having high boiling point or before mentioned oils used for pressure sensitive materials are preferable. In particular, esters are more preferable from a view point of a stability of the color developer emulsion.

Specific examples of esters include phosphates (e.g.,-triphenyl phosphate, tricresyl phosphate, butyl phosphate, octyl phosphate, cresyl-bi-phenyl phosphate), phthalates (e.g., dibutyl phthalate, 2-ethylhexyl phthalate, ethyl phthalate, octyl phthalate, buthlbenzyl phthalate, tetrahydro dioctyl phthalate, benzoates (e.g., ethyl benzoate, propyl benzoate, butyl benzoate, isopentyl benzoate, benzyl benzoate), abietates(e.g., ethyl abietate, benzyl abietate ), dioctyl adipate, diethyl succinate, isodecyl succinate, dioctyl azelate, oxalates (e.g., dibutyl oxalate, dipentyl oxalate), diethyl malonate, maleates (e.g., dimethyl maleate, diethyl maleate, dibutyl maleate), tributyl citrate, sorbic esters (methyl sorbate, ethyl sorbate, butyl sorbate), sebacic esters (dibutyl sebacate, dioctyl sebacate), ethyleneglycol esters (e.g., formic acid monoesters and diesters, butyric acid monoesters and diesters, lauric acid monoesters and diesters, palmitic acid monoesters and diesters, stearic acid monoesters and diesters, oleic acid monoesters and diesters), triacetin, diethylcarbonate, diphenylcarbonate, ethylenecarbonate, propylenecarbonate, boric acid esters (e.g., tributyl borate, tripentyl borate). Of these esters, it is particularly preferred to use tricresyl phosphate from the standpoint of stabilization of emulsified dispersion of the color developers.

Organic solvents having boiling point lower than 150° C. can be added to the foregoing organic solvents. Some of these organic solvents are ethylacetate, isopropyl acetate, butyl acetate, methylene chloride, and the like.

Water soluble high polymers to be contained as a protective colloid in an aqueous phase, which is to be mixed with an oily phase wherein color developers are dissolved, can be selected properly from known anionic, nonionic or amphoteric high polymers. Of these high polymers, polyvinylalcohol, gelatin, cellulose derivatives and the like are preferred.

Surface active agents to be contained additionally in the aqueous phase can be selected properly from anionic or nonionic surface active agents of the kind which do not cause any precipitation or condensation by interaction with the above-described protective colloids. As examples of surface active agents which can be preferably used, mention may be made of sodium alkylbenzenesulfonates (such as sodium laurylbenzenesulfonate ), sodium dioctylsulfosuccinates, polyalkylene glycols (such as polyoxyethylene nonylphenyl, ether) and so on.

An emulsified dispersion of color developers to be used in the present invention can be prepared with ease by mixing an oil phase containing the color developers and an aqueous phase containing a protective colloid and a surface active agent with a general means for preparing a fine grain emulsion, such as a high-speed stirrer, an ultrasonic disperser or so on, to disperse the former phase into the latter phase.

To the emulsified dispersion thus obtained, melting point depressants for the color developers can be added, if desired. Some of these melting point depressants have such a function as to control glass transition points of the capsule walls described hereinbefore, too. Specific examples of such melting point depressants include hydroxy compounds, carbamate compounds, sulfonamide compounds, aromatic methoxy compounds and so on. Details of these compounds are described in Japanese Patent Application No. 244190/84.

These melting point depressants can be used in an amount of 0.1 to 2 parts by weight, preferably 0.5 to 1 part by weight, per 1 part by weight of color developer whose melting point is to be depressed. It is to be desired that the melting point depressant and the color developer, whose melting point can be depressed thereby, should be used in the same place. When they are added to separate places, a preferred addition amount of the melting point depressant is 1 to 3 times of that of the above-described one.

The heat sensitive recording material of the present invention is produced by providing a heat sensitive layer on a support, such as paper, a synthetic resin film, etc., coating and drying a coating composition, in which microcapsules enclosing a color former therein and a dispersion containing at least a color developer in an emulsified condition are contained as main components, and further a binder and other additives are incorporated, according to a conventional coating method, such as a bar coating method, a blade coating method, an air knife coating method, a gravure coating method, a roll coating method, a spray coating method, a dip coating method, or so on. A coverage of the heat sensitive layer is controlled to 2.5 to 25 g/m$^2$ on a solid basis.

It is a surprise to find that thus prepared heat sensitive layer has very excellent transparency.

The transparency can be estimated by measuring Haze (%) using HTR meter (integrating - sphere photometer) manufactured by Nippon Seimitsu Kogyo K.K. However, for the transparency of a heat sensitive layer of a test sample is remarkably affected by light-scattering caused by minute roughness of a surface of the heat sensitive layer. Therefore, a transparent adhesive tape is stuck on the surface of the heat sensitive layer to prevent the light scattering then measurement is carried out to estimate an intrinsic transparency of the heat sensitive layer.

Now, it is known that the nearer the refractive indexes of materials before and after the boundary layer becomes each other, the larger a transmittance, obtained when light transmit the boundary layer, becomes. The present inventors discovered that the same explanation is possible concerning refractive index of a component contained in a microcapsule (core material) and that of a nonvolatile oil phase of a dispersion comprising a developer and an organic solvent, even though a number of components are contained in the heat sensitive layer.

In fact, haze % of the heat sensitive layer can be reduced to less than 30% when the refractive index of the former is 0.97–1.03 times of that of the latter. Especially, haze % can be reduced to less than 20% by making said ratio into a range of 0.99–1.01.

This means that the transparency of the heat sensitive layer can easily be controlled by adjusting the refractive index of the component contained in the microcapsule (core material) and that of aforementioned oil phase in the emulsified dispersion.

Above refractive indexes are measured with Abbe Refractometer manufactured by Atago Co., Ltd.

For the purpose of prevention of sticking to a thermal head, and improvement on writing quality, pigments such as silica, barium sulfate, titanium oxide, aluminum hydroxide, zinc oxide, calcium carbonate, etc., styrene beads, or fine particles of urea/melamine resin and so on can be added to the heat sensitive recording material of the present invention.

Also, metal soaps can be added for the purpose of prevention of the sticking phenomenon. They are used at a coverage of 0.2 to 7 g/m$^2$.

The heat sensitive recording material of the present invention can be formed using a coating technique with the aid of an appropriate binder.

As for the binder, water soluble polymers and various kinds of emulsions, such as a polyvinyl alcohol, a methyl cellulose, a carboxymethyl cellulose, a hydroxypropyl cellulose, a gum arabic, a gelatin, a polyvinyl pyrrolidone, a casein, a styrene-butadiene latex, an acrylonitrile-butadiene latex, a polyvinyl acetate emulsion, a polyacrylate emulsion, an ethylene-vinyl acetate copolymer emulsion, and so on, can be employed. An amount of the binder used is 0.2 to 5 g per square meter on a solids basis.

In order to prevent sticking to a thermal head and scratching to a heat sensitive layer or to add various qualities such as a water resisting property, flatness and antistatic property, it is preferable to provide at least one protective layer on the heat sensitive layer.

Some of polymers used in the protective layer are a methylcellulose, a carboxymethylcellulose, a hydroxymethylcellulose, a starch, a gelatin, a gum arabic, a casein, a hydrolyzed product of styrene-maleic anhydride copolymer, a hydrolyzed half-ester product of styrenemaleic anhydride copolymer, hydrolyzed product of isobutylene-maleic anhydride copolymer, a polyvinylalcohol, a modified polyvinylalcohol with silicon, a modified polyvinylalcohol with carboxyl group, a polyacrylamide derivatives, a polyvinyl pyrrolidone, a polystyrene sodium sulfate, a metal salt of alginic acid, styrene-butadiene rubber latex, acrylonitrile-butadienebutadiene rubber latex, methylacrylate-butadiene rubber latex, polyvinylacetate emulsion. Particularly, the modified polyvinylalcohol with silicon is preferable. These binders can be used singly or in combination. When a modified polyvinylalcohol with silicon is used together with other polymer, a preferred amount of the latter is from 0.01 to 0.5 part by weight per 1 part by weight of modified polyvinylalcohol with silicon.

In the protective layer, a pigment, metal soap, wax or cross-linking agent etc. can be added in order to improve matching of the heat sensitive material with thermal head when thermal recording is performed or to improve water resisting property of the protective layer.

Some of the pigments are a zinc oxide, a calcium carbonate, a barium sulfate, a titanium oxide, a lithopone, a talc, an agalmatolite, a kaolin, an aluminum hydroxide, an amorphous silica etc., an amount to be added is 0.05–2 times of an amount of total weight of polymer, especially 0.1–0.5 times are preferable. An amount less than 0.05 times can not improve the matching of the heat sensitive recording material with thermal head, on the other hand an amount more than 2 times reduces both transparency and sensitivity of the heat sensitive recording material remarkably, which causes damage on commercial value.

Some of the metal soaps are an emulsion of metal salt of higher fatty acid (e.g., a zinc stearate, a calcium stearate, an aluminum stearate) etc., and its amount to be added is 0.5–20 weight %, preferably 1–10 weight % against total weight of the protective layer. Some of the waxes are a paraffin wax, a microcrystalline wax, a carnauba wax, a methylol stearoamide, a polyethylene wax, an emulsion of silicone etc., and an amount thereof to be added is 0.5–40 weight %, preferably 1–20 weight % against total weight of the protective layer.

In a coating solution for the protective layer a surface active agent is added in order to prepare the protective layer uniforming on the heat sensitive layer. Some of the active agents are an alkali metal salt of sulfosuccinic acid group and an active surface agent containing fluorine atoms etc., concretely they are a sodium salt or an ammonium salt etc., of a di-(2ethylhexyl) sulfosuccinic acid or di-(n-hexyl) sulfosuccinic acid etc.

Other surface active agents, polymer electrolytes or metal oxides can also be added in the protective layer as an antistatic agent.

A preferable amount of the protective layer to be coated is usually 0.2–5 g/m$^2$, particularly 1 g–3 g/m$^2$ at the solids coverage.

As a support, an opaque base such as a paper or an undercoated paper as well as a known transparent polymer film can be used in the present invention. When a heat sensitive recording material of the present invention is intended to use for OHP, A polyethyleneterephthalate film (PET) and cellulosetriacetate film (TAc) are preferably use as the support from a view point of dimensional stability and strength etc.

As for the paper to be used as a support, neutralized paper which is sized with a neutral sizing agent like an alkylketene dimer and shows pH 6–9 upon hot extraction (Japanese Patent Application (OPI) No. 14281/'80) is employed to advantage in the respect of long-range preservation.

In order to prevent the penetration of a coating composition into paper, and in order to effect a close contact between a heat recording head and a heat sensitive recording layer, paper described in Japanese Patent Application (OPI) No. 116687/82, which is characterized by Stökigt sizing degree/(meter basis weight)$^2 \geqq 3 \times 10^{-3}$ and Beck smoothness of 90 seconds or more, is used to advantage.

In addition, paper having optical surface roughness of 8 microns or less and a thickness of 40 to 75 microns, as described in Japanese Patent Application (OPI) No. 136492/83; paper having a density of 0.9 g/cm$^3$ or less and optical contact rate of 15% or more, as described in Japanese Patent Application (OPI) No. 69097/83; paper which is prepared from pulp having received a beating treatment till its freeness has come to 400 cc or more on a basis of Canadian Standard Freeness (JIS P8121) to prevent permeation of a coating composition thereinto, as described in Japanese Patent Application (OPI) No. 69097/83; raw paper made with a Yankee paper machine, which is to be coated with a coating composition on the glossy side and thereby, improvements on developed color density and resolution are intended, as described in Japanese Patent Application (OPI) No. 65695/83; raw paper which has received a corona discharge processing and thereby, its coating aptitude has been enchanced, as described in Japanese Patent Application (OPI) No. 35985/84; and so on can be employed in the present invention, and can bring about good results. In addition to the above-described papers, all supports which have so far been used for general heat sensitive recording papers can be employed as the support of the present invention.

A transparency of heat sensitive recording layer of the present invention can easily be adjusted by controlling a refractive index of a component contained in a microcapsule and that of a oily phase in a color developer emulsified dispersion.

Since a transparency of a heat sensitive layer of the present invention is quite excellent, a printed matters can be seen through the heat sensitive layer. Moreover not only a reproducibility of multi colors is improved, but also when it is applied on a transparent support to use for an OHP, a quality of the OHP is same to that of known OHP.

EXAMPLES

The present invention is illustrated in greater detail by reference to the following examples. However, the invention should not be construed as being limited to these examples.

EXAMPLE 1

(Preparation of Capsule Solution)

14 g of Crystal Violet lactone (leuco dye), 60 g of Takenate D 110N (Trade name of capsule wall material, produced by Takeda Yakuhin K.K. ) and 2 g of Sumisoap 200 (Trade name of ultraviolet absorbent, produced by Sumitomo Kagaku K.K.) were added to a mixed solvent consisting of 55 g of 1-phenyl-1-xylylethane and 55 g of methylene chloride, and dissolved therein. The solution of the above-described leuco dye was mixed with an aqueous solution constituted with 100 g of a 8% water solution of polyvinyl alcohol, 40 g of water and 1.4 g of a 2% water solution of sodium dioctylsulfosuccinate (dispersant), and emulsified with stirring at 10,000 r.p.m. for 5 minutes using Ace Homogenizer made by Nippon Seiki K.K.. Then, the resulting emulsion was diluted with 150 g of water, and allowed to stand at 40° C. for 3 hours to conduct the microencapsulation reaction therein. Thus, a solution containing microcapsules having size of 0.7 micron was obtained.

(Preparation of Color Developer-emulsified Dispersion)

The color developers (a), (b) and (c) represented by the structural formulae illustrated below were added in amounts of 8 g, 4 g and 30 g, respectively, to a solvent mixture of 2.0 g of 1-phenyl-1-xylylethane, 6.0 g of dibutylphthalate and 30 g of ethyl acetate, and dissolved thereinto. The thus obtained solution of the color developers was mixed with 100 g of a 8% water solution of polyvinyl alcohol, 150 g of water and 0.5 g of sodium dodecylbenzensulfonate, and emulsified with stirring at 10,000 r.p.m. for 5 minute at ordinary temperature using Ace Homogenizer made by Nippon Seiki k.k. to prepare an emulsified dispersion having a grain size of 0.5 micron.

Zinc Salt of

Color Developer (a)

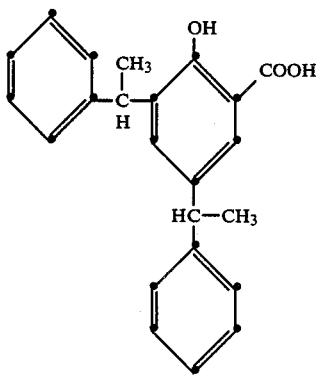

Color Developer (b)

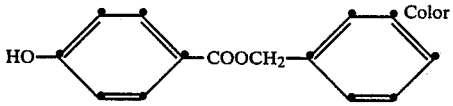

Color Developer (c)

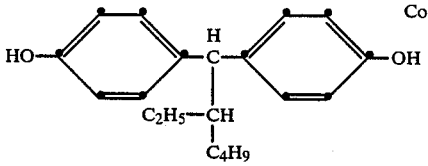

Production of Heat Sensitive Material

A 5.0 g portion of the foregoing capsule solution, a 10.0 g portion of the foregoing color developer-emulsified dispersion and 5.0 g of water were mixed with stirring, coated on a 70 micron-thick transparent polyethylene terephthalate (PET) film support at a coverage of 15 g/m$^2$ on a solids basis, and dried. Thereon, a 2 micron-thick protective layer having the following composition was further provided to produce a transparent heat sensitive film.

| (Composition of Protective Layer) | |
|---|---|
| 10% water solution of polyvinylalcohol | 20 g |
| Water | 30 g |
| Sodium salt of 2% dioctyl sulfosuccinate | 0.3 g |
| Kaolin dispersion of 3 g of polyvinylalcohol, 100 g of water and 35 g of Kaolin dispersed by ball mill. | 3 g |
| Zinc stearate | 0.5 weight part (solid basis) |
| (Hidolin Z-7: manufactured by Chukyo Yushi K.K.) | |

On the thus obtained heat sensitive recording material, thermal recording was carried out using a G III-mode thermal printer (Mitsubishi Melfas 600 (trade name) manufactured by Mitsubishi Denki K.K.) and blue image was obtained. A transmittal image density was measured as 0.7 using McBeth densitometer and the image was able to see by OHP.

EXAMPLES 2–12 AND COMPARATIVE EXAMPLE 1

A transparent black image was obtained by the same procedure as in Example 1 except using the following oil cited in the table 1 instead of oils of the 1-phenyl-1-xylylethane and the dibutyl phthalate used for the preparation of a color developer emulsified dispersion.

TABLE 1

| Example | oil | density | stability |
|---|---|---|---|
| 2 | tricresylphosphate | 0.53 | excellent |
| 3 | tricresylphosphate/ diethylmaleate | 0.61 | excellent |
| 4 | di-isodecylphthalate | 0.60 | good |
| 5 | di-butylphthalate | 0.61 | good |
| 6 | dioctylphthalate | 0.62 | good |
| 7 | dioctylazelate | 0.59 | good |
| 8 | dibutylfumalate | 0.57 | good |
| 9 | diphenylcarbonate | 0.57 | good |
| 10 | propylenecarbonate | 0.57 | good |
| 11 | diethylmaleate | 0.59 | good |
| 12 | dibutylmaleate | 0.59 | good |
| Comparative example 1. | 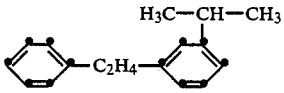 | 0.59 | bad |

density: Transparent image density measured by McBeth densitometer
stability: Stability of emulsified dispersion Each of the thus obtained color developer-emulsified dispersions was diluted by adding 0.5 parts of water, stirred for 6 hours with a stirrer, and then coated on a PET bases. The surface condition of each coat was observed with the eyes and thereby, comparison extents of emulsification stability were made. The above results were shown in Table 1 together with the McBeth transmission density.

EXAMPLE 13

FIG. 1 is a cross section of the present heat sensitive recording material which is used for labels. In the figure, a symbol 1 is a support, 2 represents an image printed on the support and 3 is the present transparent heat sensitive layer prepared in Example 1. Since the transparency of the heat sensitive layer is excellent, images printed on the support are able to see through the heat sensitive layer. This fact proves that desired matters can be printed on a support before a heat sensitive layer is coated on the support. Therebefore, papers, which are able to absorb ink easily, can be used as a support and printing on the support using a cheap aqueous ink is possible, then a blocking phenomenon can be prevented. It easily estimated that if necessary, a transparent film and the like can be used as the support.

EXAMPLES 14 - 16, COMPARATIVE EXAMPLES 2, 3 and 4

Preparation of Capsule Solution

Compounds A shown in the Table 2 and 20 g of Takenate D-110N (capsule wall material produced by TAKEDA YAKUHIN K.K.) were added into 25 g of methylenechloride and dissolved. This solution containing the leuco dye was mixed with an aqueous solution constituted with 50 g of a 8% water solution of polyvinylalcohol, 15 g of water and 0.2 g of 2% water solution of sodium dioctylsulfosuccinate (dispersant), and emulsified with stirring at 10,000 r.p.m. for 5 minutes using an Ace Homogenizer made by Nippon Seiki K.K.. Then, the resulting emulsion was diluted with 150 g of water and allowed to stand at 40° C. 3 hours to conduct the microencapsulation reaction therein. Thus a solution containing microcapsules having a size of 0.7 micron was obtained.

TABLE 2

| Ex. No. | A: core material | | B: nonvolatile oil phase of a dispersion | |
|---|---|---|---|---|
| 14 | 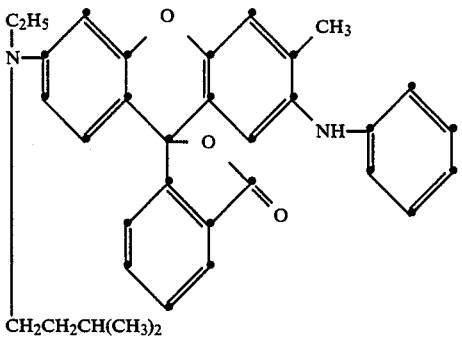 | 6 g | 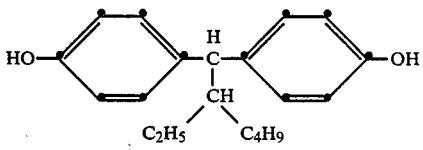 | 12 g |
| | 1-phenyl-1-xylylethane | 24 g | 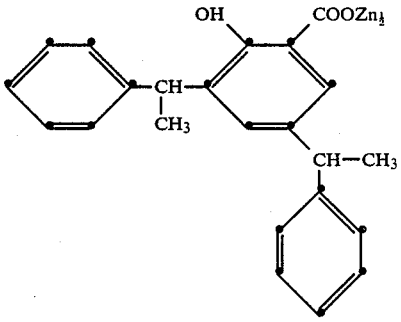 | 3 g |
| | | | diethyl maleate | 3 g |
| 15 | 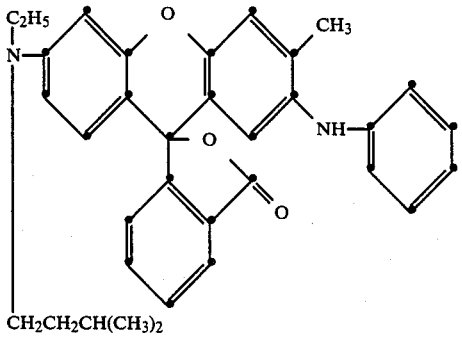 | | 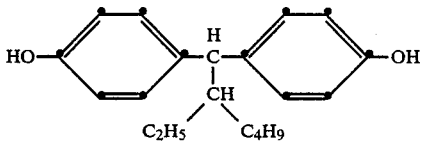 | 12 g |

TABLE 2-continued
| Ex. No. | A: core material | | B: nonvolatile oil phase of a dispersion | |
|---|---|---|---|---|
| | diethyl succinate | 15 g | 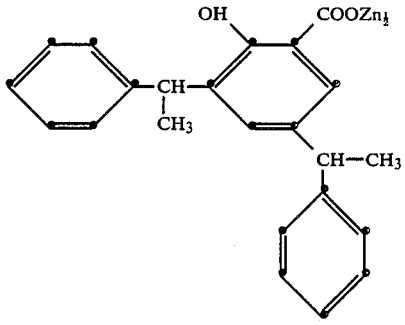 | 3 g |
| | | | diethylmaleate | 3 g |
| 16 | 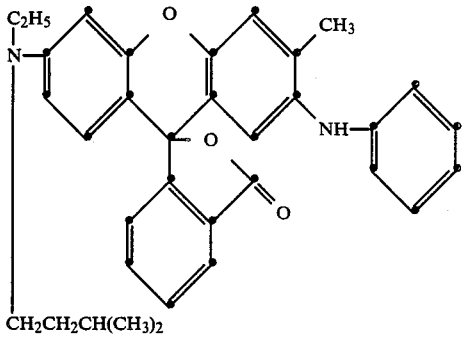 | 6 g | 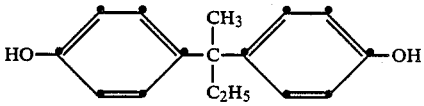 | 13 g |
| | 1-phenyl-1-xylylethane | 24 g | 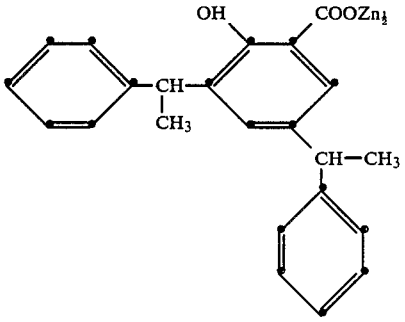 | 2 g |
| | | | diethylmaleate | 3 g |
| Comparative example 2 | 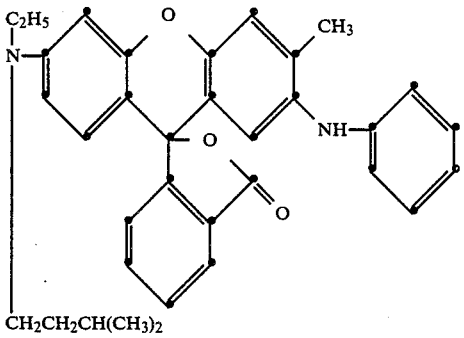 | 10 g | 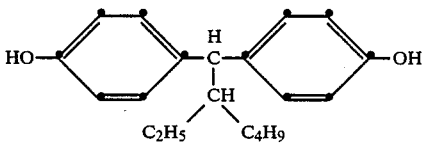 | 13 g |
| | 1-phenyl-1-xylylethane | 20 g | diethylmaleate | 5 g |

TABLE 2-continued

| Ex. No. | A: core material | | B: nonvolatile oil phase of a dispersion | |
|---|---|---|---|---|
| Comparative example 3 | 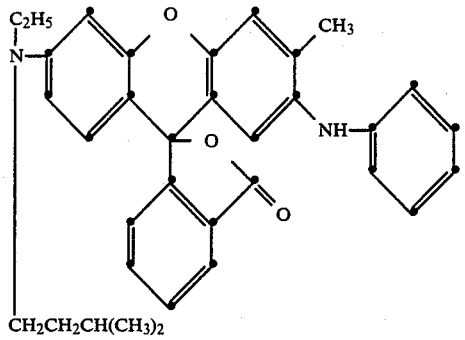 | 10 g | 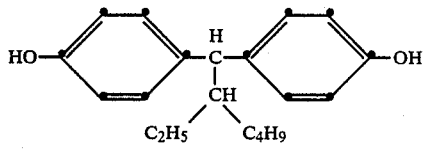 | 10 g |
| | 1-phenyl-1-xylylethane | 24 g | 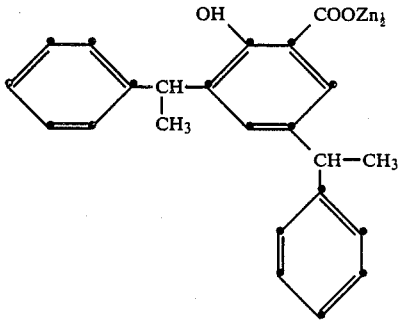 | 1 g |
| | | | diethylmaleate | 7 g |
| Comparative example 4 | 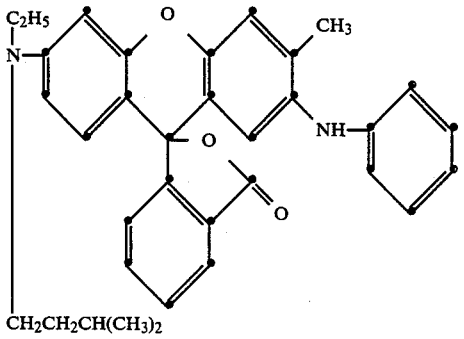 | 10 g | 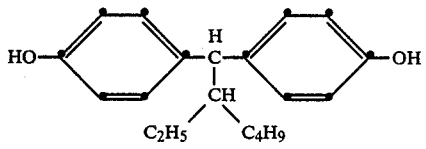 | 12 g |
| | diethylmaleate | 21 g | 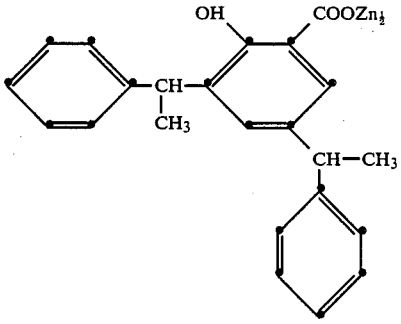 | 3 g |
| | | | diethylmaleate | 3 g |

Preparation of Color Developer-emulsified Dispersion

Compounds B shown in the Table 2 were dissolved into 10 g of ethylacetate. Obtained solution of the color developers was mixed with 50 g of a 8% water solution of polyvinylalcohol, 50 g of water and 0.5 g of sodium dodecylbenzensulfonate, and emulsified with stirring at 10,000 r.p.m. for 5 minutes at ordinary temperature using Ace Homogenizer made by Nippon Seiki k.k. to prepare an emulsified dispersion having a grain size of 0.5 micron.

Production of Heat Sensitive Material

A 5.0 g portion of the foregoing capsule solution, a 10.0 g portion of the foregoing color developer-emulsified dispersion and 5.0 g of water were mixed with stirring, coated on a 70 micron-thick transparent polyethylene terephthalate (PET) film support at a coverage of 15 g/m$^2$ on a solid basis, and dried. Thereon, a 2 micron-thick protective layer having the following composition was further provided to produce a transparent heat sensitive film.

| Composition of Protective Layer | |
|---|---|
| Modified Polyvinylalcohol with silicon (PVA R2105: manufactured by Kurare K.K.) | 1 weight part (solid basis) |
| Colloidal silica (Snowtex 30: manufactured by Nissan) Kagaku K.K.) | 1.5 weight part (solid basis) |
| Zinc stearate (Hidolin Z-7: manufactured by Chukyo Yushi k.k.) | 0.02 weight part (solid basis) |
| Paraffin wax (Hidolin P-7: manufactured by Chukyo Yushi k.k.) | 0.01 weight part (solid basis) |

On the each sample produced by using each material shown in Table 2 the refractive index of a component contained in a microcapsule (core material) and that of nonvolatile component oil of phase of the color developer dispersion were measured with Abee refractometer. The measurement of the refractive indexes were carried out on solutions obtained as follows; the core material or the nonvolatile component of developer dispersion was heated together with a small amount of ethylacetae to give a solution, then ethylacetate was distilled off. The results of above measurements were shown in Table 3 together with Haze % measured using HTR meter (integrating-sphere photometer) manufactured by Nippon Seimitsu Kogyo K.K..

TABLE 3

| EXAMPLE No. | Ra | Rb | Ra/Rb | Haze (%) |
|---|---|---|---|---|
| 14 | 1.568 | 1.553 | 1.010 | 16 |
| 15 | 1.534 | 1.553 | 0.987 | 16 |
| 16 | 1.568 | 1.576 | 1.001 | 15 |
| Comparative (2) | 1.578 | 1.531 | 1.031 | 30 |
| Comparative (3) | 1.568 | 1.520 | 1.031 | 31 |
| Comparative (4) | 1.499 | 1.553 | 0.965 | 32 |

Ra: Refractive Index of core material of microcapsule
Rb: Refractive Index of nonvolatile component of Oil Phase in emulsified dispersion The results shown in Table 3 proves that the Haze % of a heat sensitive recording material of the present invention is small and transparency of the heat sensitive recording material is quite excellent.

What is claimed is:

1. Heat sensitive recording materials comprising a support having thereon at least one heat sensitive layer containing a colorless or light colored electron donating dye precursor enclosed in a microcapsule and a color developer, which recording material is manufactured by a method which comprises coating a composition containing (a) an emulsified dispersion prepared by dissolving said color developer in an organic solvent slightly soluble or insoluble in water and dispersing said developer containing solvent, and (b) said microcapsules on a support then drying the coat to provide a transparent heat sensitive layer.

2. Heat sensitive recording materials as claimed in claim 1, wherein said support is made of a paper.

3. Heat sensitive recording materials as claimed in claim 1, wherein a printing on the support has been carried out using one or more aqueous ink.

4. Heat sensitive recording materials as claimed in any one of claims 1, to 3, wherein said transparent heat sensitive layer has a sufficient heat sensitivity to record using thermal head.

5. A heat sensitive recording material as in claim 1, wherein said refractive index of a component enclosed in the microcapsule is within the range of 0.99–1.01 times that of a nonvolatile oil phase of a dispersion comprising the developer and the organic solvent.

6. Heat sensitive recording materials comprising a printed support having thereon at least one transparent heat sensitive layer, wherein said heat sensitive layer contains a colorless or light colored electron donating dye precursor enclosed in a microcapsule and a color developer, and wherein said transparent heat sensitive layer is produced by a process comprising dispersing said microcapsules and said color developer in an organic solvent slightly soluble or insoluble in water to form an emulsified dispersion, wherein the refractive index of the component enclosed in the microcapsule is adjusted to within a range of 0.97–1.03 times of that of the nonvolatile oil phase of a dispersion comprising the developer and the organic solvent, coating said dispersion on a support, and drying the coat to provide a transparent heat sensitive layer.

* * * * *